United States Patent [19]

Machler

[11] 4,199,045

[45] Apr. 22, 1980

[54] LUGGAGE IDENTIFICATION SYSTEM EMBODIED IN VALANCE

[75] Inventor: Ronald A. Machler, Germantown, Tenn.

[73] Assignee: Roper Corporation, Kankakee, Ill.

[21] Appl. No.: 16,808

[22] Filed: Mar. 2, 1979

[51] Int. Cl.[2] ..... A45C 13/26; A45C 13/42; G09F 3/18

[52] U.S. Cl. ..... 190/49; 40/16.4; 40/17; 190/28

[58] Field of Search ..... 40/10 R, 10 D, 16, 17, 40/16.4; 190/28, 49

[56] References Cited

U.S. PATENT DOCUMENTS

| | | | |
|---|---|---|---|
| 2,362,273 | 11/1944 | Hopp | 40/16 X |
| 2,545,262 | 3/1951 | Coleman | 40/10 R |
| 2,950,793 | 8/1960 | Axtell | 190/49 |

*Primary Examiner*—Allan N. Shoap
*Attorney, Agent, or Firm*—C. Frederick Leydig; Richard L. Voit; David J. Richter

[57] ABSTRACT

A luggage construction in which opposed shells are fitted with mated valances, one of the valances having a flat seating surface with an adjacent first wall and the other valance presenting a second wall parallel to the first so that the valances, in mating engagement, define an outwardly facing channel. Seated in the channel is a mounting member in the form of a flat strip having at its ends relatively thick retaining portions and a thin center portion resulting in a central recess of rectangular shape having opposed end walls. The end walls are formed with overhangs. A lens of matching rectangular shape has its ends in keyed engagement with the overhangs to permit the lens to be pressed laterally edgewise into seated position when the luggage is open. The presented second wall of the channel serves to obstruct the adjacent lateral edge of the lens when the luggage is closed to preclude removal of the lens as long as the luggage is in locked condition. This prevents unauthorized removal or alteration of an address label viewable under the lens.

9 Claims, 11 Drawing Figures

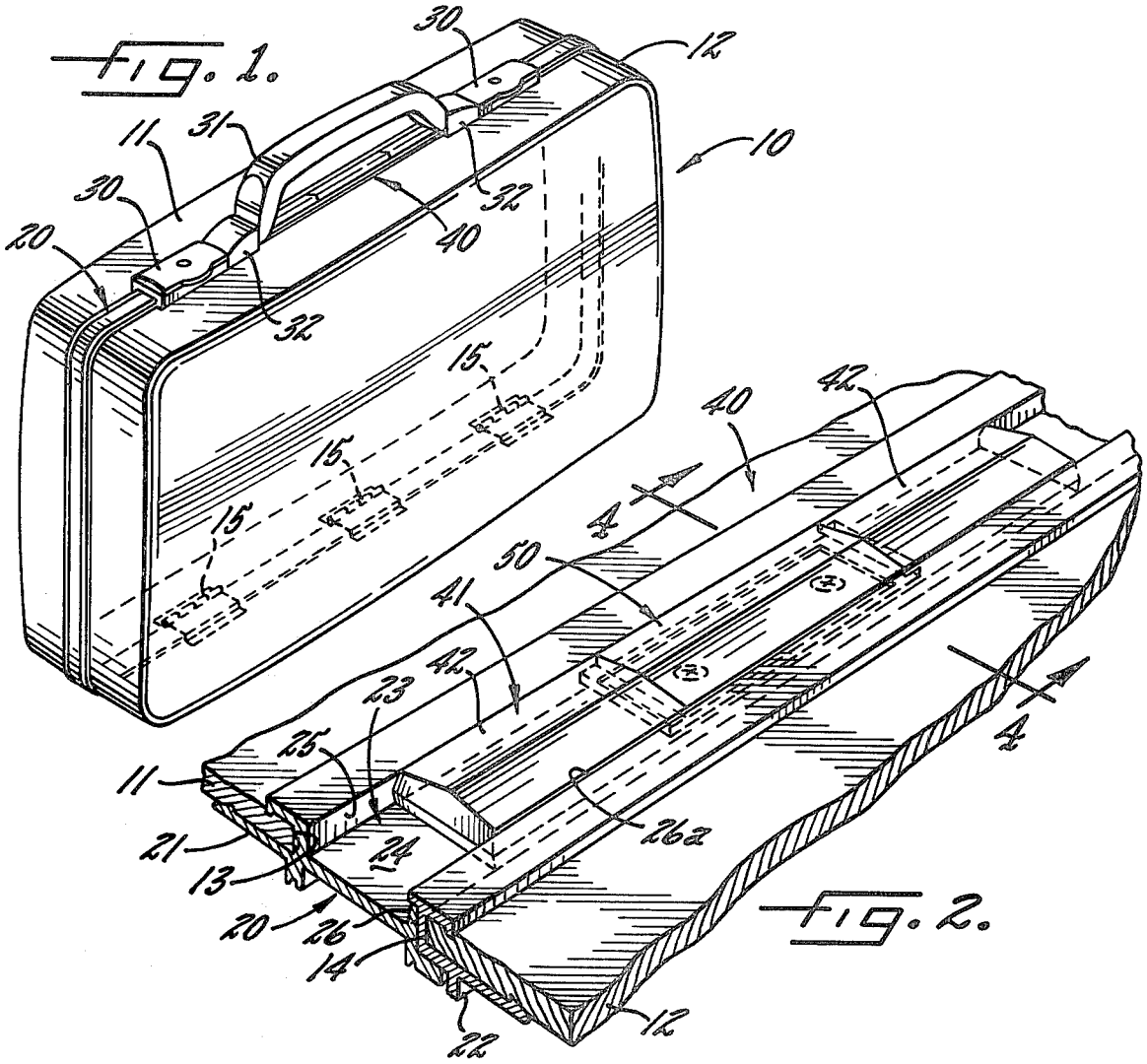
Fig. 1.
Fig. 2.
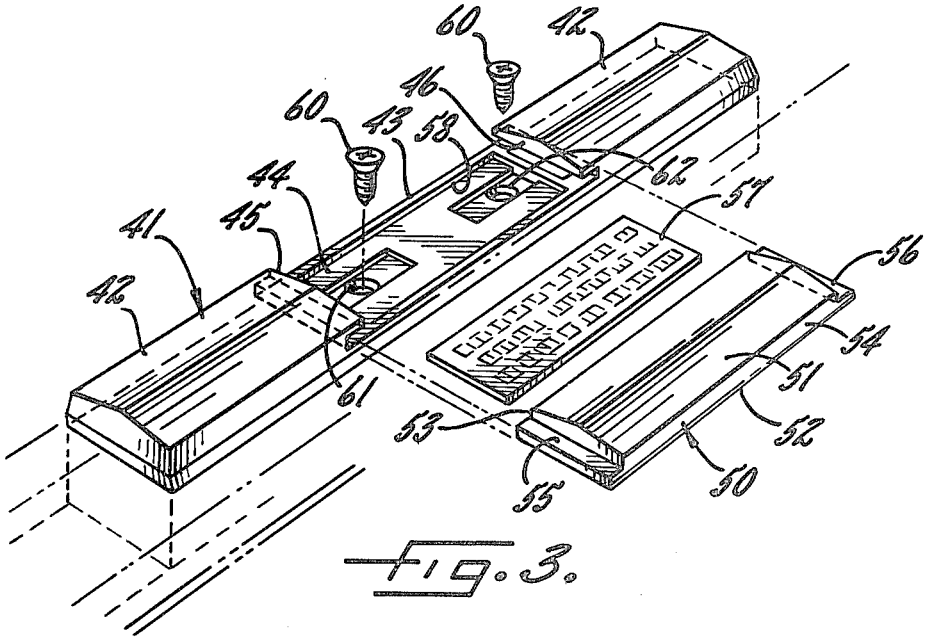
Fig. 3.

LUGGAGE IDENTIFICATION SYSTEM EMBODIED IN VALANCE

It is a common practice, indeed one required by many carriers, to identify a piece of luggage by a tag or label giving the name and address of the owner. It has been recognized in the past that the identifying label may be integrated into the bag structure in such a way as to inhibit removal, substitution or tampering.

Thus in Hiering U.S. Pat. No. 1,612,919 the identifying information is on a strip captively slidable into a channel formed in the frame of the luggage, with a metal tab at the end of the channel being bent to keep the strip in place. The structure is not completely secure, however, since anyone equipped with a pair of pliers can straighten the tab and substitute a different strip.

An improvement in security is provided by Ikelheimer U.S. Pat. No. 1,747,077. This patent shows an identifying card viewable in a pocket having a transparent wall. To prevent removal or substitution, the mouth of the pocket is normally closed by a blocking member which can be sprung to an out-of-the-way position by a release member accessible only from the inside of the bag when the bag is open.

In the Coleman U.S. Pat. No. 2,545,262, which also shows a pocket having a transparent viewing wall, the pocket penetrates the wall of the bag and has an entryway which is only accessible from the inside of the bag when the bag is open.

While the devices shown in the latter two patents provide a measure of security, they do require mutilation of the wall of the bag and neither device is easy to use or particularly attractive.

It is, accordingly, an object of the present invention to provide a luggage identification structure and system in which the identification is totally embodied in the bag hardware, requiring neither penetration or mutilation of the side wall, or shell, and which offers a high degree of security, preventing removal or substitution as long as the bag is locked closed. It is indeed an object to provide a luggage identification means which is substantially tamper-proof even with resort to a prying tool or the like. More specifically it is an object to provide means for mounting an identification label in which the label is clearly but unobtrusively displayed in a captively recessed position in a channel between a mated pair of valances.

It is another object to provide a luggage identification holder which is easy to use employing a stiff transparent lens which is slidable edgewise into a nested captive position and which may be easily and quickly removed for the changing of address information when the luggage is open, at the option of the owner. Indeed, change or substitution may be effected upon opening the bag only an inch or two.

It is yet another object to provide luggage identification which is neat, integrated and attractive, the label being covered and protected by a monolithic lens of transparent plastic mounted so as to be flush with the surrounding hardware, the appearance suggesting a jewel in a metal setting.

It is a still further object of the present invention to provide a luggage identification device and procedure which is inherently economical to manufacture and install and which is universally applicable to pieces of luggage of various sizes and shapes.

Other objects and advantages of the invention will become apparent upon reading the attached detailed description and upon reference to the drawings in which:

FIG. 1 is a perspective view of a piece of luggage employing the present invention.

FIG. 2 is an enlarged fragmentary perspective showing a mounting member and its associated lens in assembled condition.

FIG. 3 is a perspective showing the mounting member, fasteners therefor, lens and address label in exploded relation.

Figure 4:
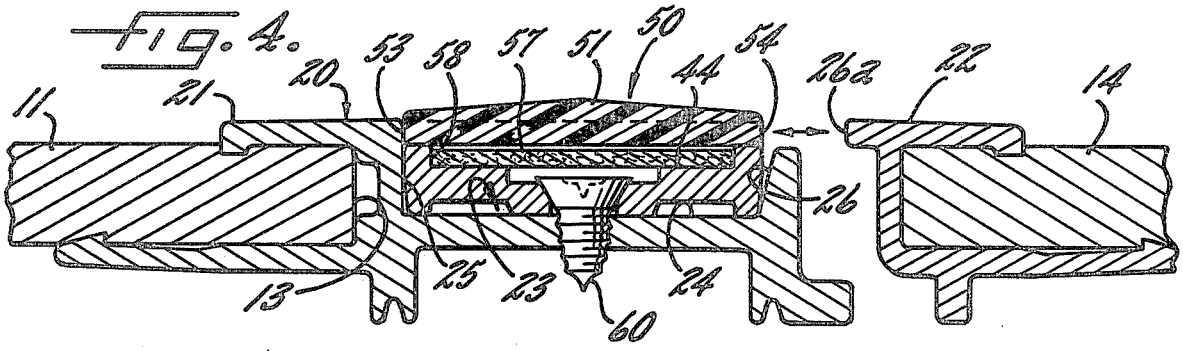
FIG. 4 is an enlarged cross section looking along line 4—4 in FIG. 2 with the valences slightly separated.
Figure 5:
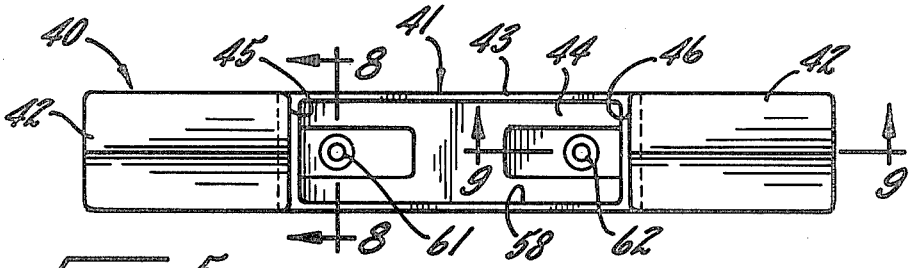
FIG. 5 is the top view of a mounting member constructed in accordance with the invention.
Figure 6:
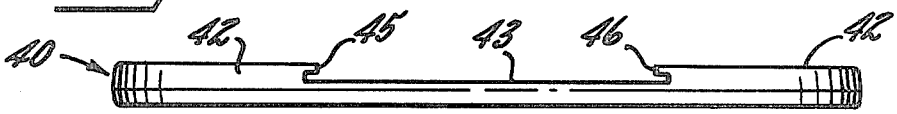
FIG. 6 is an elevational, or edge, view.
Figure 7:
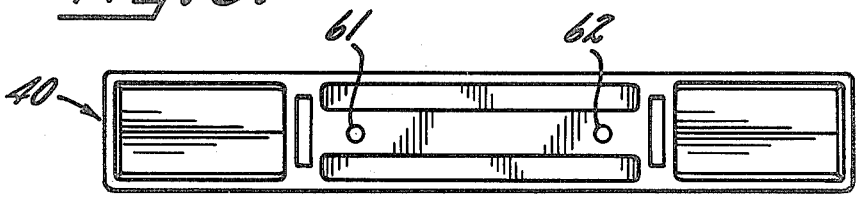
FIG. 7 is an underside view.
Figure 8:
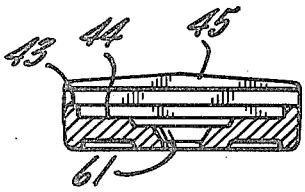
FIG. 8 is a transverse section looking along line 8—8 in FIG. 5.

While the invention has been described herein in connection with a preferred embodiment, it will be understood that I do not intend to be limited to the particular embodiment shown but intend, on the contrary, to cover the various alternative and equivalent constructions included within the spirit and scope of the appended claims.

Turning now to FIGS. 1 and 2 of the drawings there is shown a typical piece of luggage 10 made up of a pair of shells 11, 12 having mated edges 13, 14, the shells being hinged together along the bottom at hinges 15.

Extending around the mated edges of the shells is a valance structure 20 including a first or relatively stationary valance 21 and a second or relatively movable valance 22. The valances 21, 22 are preferably in the form of polished aluminum extrusions formed into rectangular loops and stretched to exactly the same size and thus perfectly fitted to one another.

The valances define between them a channel 23 having a bottom or seating surface 24, a first wall 25 and a second wall 26, the seating surface and first wall being a part of the stationary valance 21.

In accordance with the present invention the second wall is formed, at least the upper edge portion thereof, by the second or relatively movable valance 22, the part of the wall associated with the second valance being indicated at 26*a*. Thus the two valances in the mated condition illustrated in FIG. 2, together, define the outwardly facing channel which is required in the practice of the present invention.

For the purpose of locking the two valances together in mated condition, locks 30 are used in the region opposite the hinge. Any desired lock structure may be employed and the specific lock construction does not form a part of the present invention. Centered between the locks is a handle 31 having handle mounts 32 which are secured to the stationary valance 21.

Figure 9:
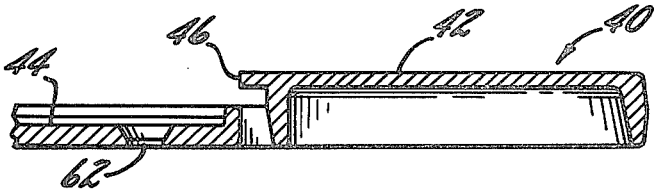
FIG. 9 is a fragmentary longitudinal section looking along line 9—9 in FIG. 5.

Seated in the channel 23, preferably, but not necessarily, under the arch of the handle 31, is an identification assembly 40, which is shown in exploded perspective in FIG. 3. Such assembly includes a mounting member 41 in the form of a flat strip dimensioned in accordance with the cross section of the channel for securing to the seating surface 24 at the bottom of the channel. The mounting member has at its ends relatively thick retaining portions 42 and a thin central portion 43 to form a recess, or shallow well, 44 of rectangular shape bounded by generally parallel end walls, the end walls being formed with mutually opposed overhangs 45, 46 (see FIGS. 5–8). A lens element 50 of matching rectangular shape has a top surface 51, an undersurface 52, lateral edges 53, 54 and end surfaces 55, 56 which are keyed with respect to the overhangs 45, 46 (see also FIGS. 9–11). The lens overlies an identification label, or tag, 57 carrying the name and address of the owner, or similar information. If desired, the central portion of the mounting member 41 may be relieved as indicated at 58 to receive the label 57 and to keep it centered under the lens.

For the purpose of securing the mounting member 41 to the seating surface 24 in the channel, suitable self-tapping screws 60 are used penetrating clearance openings 61, 62, respectively.

Figure 10:
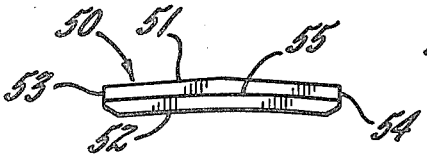
FIG. 10 is an end view of the lens.
Figure 11:
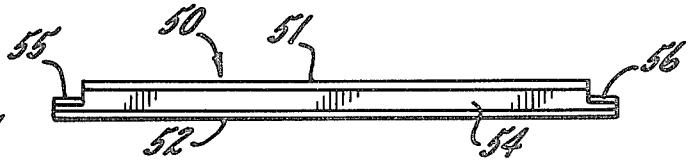
FIG. 11 is an elevational, or edge, view of the same.

Assembly of the identification means is a simple matter: Referring to FIG. 3, and assuming that luggage is in open condition, the lens 50, superimposed upon the address label 57, is simply slide edgewise into position in the mounting member, with the ends of the lens in keyed engagement with the overhangs 45, 46. Where the construction includes an auxiliary recess 58, the label 57 may be placed in the recess before the lens is slid into position. To prevent inadvertent dislodgement of the lens when the bag is in open condition, the lens preferably has a slightly interfering fit with respect to the overhangs. Specifically, the ends 55, 56 of the lens may be slightly crowned, as shown in FIG. 10, to achieve the frictional engagement.

The lens is preferably much thicker and stiffer than the usual address cover and molded of transparent acrylic plastic which is preferred for its strength, transparency and jewel-like attributes.

The shallow wall 26 (FIG. 4) which forms a part of the stationary valance is sufficiently low so that it does not obstruct either the inward or outward movement of the lens but it is, nevertheless, sufficiently high so that the mounting member 40 has a secure and doubly-walled seat in which to nest, the seating provision enabling a sufficiently snug fit so that relatively light fastening screws 60 suffice for attachment.

However, when the bag is closed, the presented upper edge 26*a* of the movable valance, which forms a continuation of the wall 26, serving to bring it up to full height, moves into obstructing engagement with the presented edge 54 of the lens, providing protection which is so complete that no portion of the lens substantially projects and so that there is no clearance for entry of a knife blade or similar prying tool.

In accordance with one of the more detailed aspects of the invention the handle mounts 32 (FIG. 1) are secured to the relatively stationary valance 21 in positions which so closely straddle the mounting member as to protect the mounting member against insertion of a prying tool along the bottom of the channel. Thus it suffices that the mounting member 41, while normally made of a relatively brittle die casting, is adequately strong for its intended purpose even though held by only a pair of screws in a central position. In short, once the bag is closed and locked, there is no easy or practical way of removing or changing the identifying information.

Nevertheless, it is one of the features of the construction that removal of the label for replacement or modification is an extremely easy matter when the bag is opened thereby to remove the obstructing effect of the presented upper edge 26*a* of the movable valance. The lens is simply slid out of position with light fingertip pressure and then back into position with the new label underneath. This can be accomplished even when the bag is full and upon separation of the valances by only an inch or two. The construction permits full access to the label, and consequently "face" retrieval rather than the "edge" retrieval required in the above-mentioned prior art devices in which a tool such as a tweezer is often required for grasping the edge of the old label to pull it out edgewise, with risk that the label may come apart in the process.

It is, moreover, one of the features of the present construction that no mutilation or penetration of the shell is necessary, which is expensive to accomplish and unsightly in result.

The present construction is distinguished not only by security but by its attractive and luxurious, yet understated, appearance.

The construction may be universally adapted to all types and sizes of bags employing cooperating valances forming a central channel, even bags which have a round or slightly oval silhouette. The invention is also applicable to valances in which the seating surface of the channel is not planar in the transverse direction, provided that the underside of the mounting member is shaped to be in at least partial area contact.

While it is one of the features of the present invention to provide a mounting member having relatively thick end portions and a thin central portion defining a central recess, it will be understood that the invention is not limited thereto and the thin central portion may, if desired, be entirely eliminated, provided that suitable means is used for directly attaching the relatively thick end portions 42 to a movable valance. In short, the portions 42, which carry the overhangs, may be in the form of a pair of retaining elements individually secured in spaced positions along the seating surface adjacent the blocking means and presenting mutually opposed overhangs with the rectangular area between them receiving a lens of matching rectangular shape.

In the use of the term "lens" thus far it has been assumed that the term applies to an element of transparent plastic protecting the address label and through which the label is clearly viewable. However, the invention in its broader aspect is not limited thereto and, if desired, the separate label 57, which is normally of paper stock, may be eliminated and the information may be applied to the upper surface of the lens by printing or heat-embossment. In such event the lens may be made of opaque material while still achieving most of the benefits of the invention.

What I claim is:

1. In a luggage construction a pair of shells having mated edges and hinge means for connecting said shells together along one side, a pair of mated valances, one of which is relatively stationary and one of which is relatively movable, extending along the respective mated edges of the shells, the valances being in mating engagement when the luggage is in closed condition, locking means coupling together the valances in the region opposite the hinge means for intentionally locking the luggage in closed condition, the stationary valance having a seating surface and an adjacent first wall and the movable valance presenting a second wall parallel to the first so that the two valances in mating engagement define an outwardly facing channel, a mounting member dimensioned to seat in the channel in the region opposite the hinge means, the mounting member having at its ends relatively thicker retaining portions and a thin central portion to form a lens receiving recess bounded by end walls, the end walls being formed with mutually opposed overhangs, a lens matching the shape of the recess and having its ends in retentively keyed engagement with the respective overhangs to permit the lens to be pressed laterally edgewise into seated position between the retaining portions when the luggage is in open condition, the adjacent and presented walls of the channel being of such height as to obstruct the respective lateral edges of the lens when the luggage is in closed condition thereby to defy removal of the lens as long as the valance locking means is in locked condition.

2. In a luggage construction a pair of shells having mated edges and hinge means for connecting said shells together along one side, a pair of mated valances, one of which is relatively stationary and one of which is relatively movable, extending along the respective mated edges of the shells, the valances being in mating engagement when the luggage is in closed condition, locking means coupling together the valances in the region opposite the hinge means for intentionally locking the luggage in closed condition, the stationary valance having a seating surface bounded by first and second parallel walls defining an outwardly facing channel, the second wall being of relatively shallow height as compared to the first, a mounting member in the form of a flat strip dimensioned to seat in the channel adjacent the locking means, the mounting member having a central portion of shallow height and of rectangular shape bounded at its ends by thicker retaining portions having mutually opposed overhangs, the movable valance having an inwardly presented upper edge which when the valances are in mating engagement overlies and forms a continuation of the second wall to bring it up to the height of the first wall, a lens of matching rectangular shape having its ends in retentively keyed engagement with the respective overhangs to permit the lens to be pressed laterally edgewise into seated position keyed to the overhangs when the luggage is in open condition, the presented upper edge of the movable valance serving to obstruct the adjacent lateral edge of the lens when the luggage is in closed condition thereby to defy removal of the lens as long as the valance locking means is in locked condition.

3. In a luggage construction a pair of shells having mated edges and hinge means for connecting said shells together along one side, a pair of mated valances, one of which is relatively stationary and one of which is relatively movable, extending along the respective mated edges of the shells, the valances being in mating engagement when the luggage is in closed condition, locking means coupling together the valances in the region opposite the hinge means for intentionally locking the luggage in closed condition, the stationary valance having a seating surface and an adjacent first wall and the movable valance presenting a second wall parallel to the first so that the two valances in mating engagement define an outwardly facing channel, a pair of retaining elements secured in spaced positions along the seating surface in the region opposite the hinge and presenting mutually opposed overhangs with a lens receiving area between them, a lens of matching shape having its ends in retentively keyed engagement with the respective overhangs to permit the lens to be pressed laterally edgewise into seated position between the retaining members when the luggage is in open condition, the adjacent and presented walls of the channel being of such height as to obstruct the respective lateral edges of the lens when the luggage is in closed condition thereby to defy removal of the lens as long as the valance locking means is in locked condition.

4. The combination as claimed in claim 1 or claim 2 or claim 3 in which the lens has a slightly interfering fit with respect to the overhangs so that the lens is frictionally retained in position thereunder.

5. The combination as claimed in claim 1 or claim 2 or claim 3 in which the end edges of the lens engaged by the respective overhangs are slightly crowned to provide a frictional fit therewith.

6. The combination as claimed in claim 1 or claim 2 or claim 3 in which an address label is located under the lens and the lens is formed of transparent plastic for viewing of the label.

7. The combination as claimed in claim 1 or claim 2 in which the top surface of the retaining portions is flush with and forms a substantially smooth continuation of the top surface of the lens.

8. The combination as claimed in claim 1 or claim 2, an address label associated with the lens, the central portion of the mounting member having a pair of through-openings for reception of fasteners to permanently secure the mounting member in seated position in the channel, with the fasteners being hidden and inaccessible under the address label.

9. The combination as claimed in claim 1 or claim 2 including a handle having mounts at its ends for anchoring the same, the mounts being secured to the relatively stationary valance in positions so closely straddling the mounting member as to protect the mounting member against entry of a prying tool thereunder.

* * * * *